United States Patent [19]

Okumura

[11] 4,249,050

[45] Feb. 3, 1981

[54] VACUUM SWITCH

[75] Inventor: Hiroyuki Okumura, Chigasaki, Japan

[73] Assignee: Tokyo Shibaura Denki Kabushiki Kaisha, Japan

[21] Appl. No.: 865,790

[22] Filed: Dec. 30, 1977

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 809,262 | 1/1906 | Hood | 200/144 B |
| 2,027,835 | 1/1936 | Rankin et al. | 200/144 B |
| 2,383,973 | 9/1945 | Jones, Jr. | 200/144 B |
| 2,491,338 | 12/1949 | Smith, Jr. | 200/144 B |
| 3,261,954 | 7/1966 | Yonkers | 200/144 B |
| 3,399,286 | 8/1968 | Kerr, Jr. | 200/144 B |
| 3,597,558 | 8/1971 | Gotsch et al. | 200/144 B |
| 3,903,386 | 9/1975 | Yanagisawa | 200/144 B |

*Primary Examiner*—Robert S. Macon

*Attorney, Agent, or Firm*—Stevens, Davis, Miller & Mosher

[57] ABSTRACT

A vacuum switch having a vacuum vessel and a pair of separable contacts disposed in the vessel comprises a pair of opposing shields surrounding the contacts respectively in the vacuum vessel, and the shields have reentrant portions in which the contacts are positioned respectively at opened state and the distance between the opposing faces of the shields is shorter than the distance between the contacts at the opened state.

1 Claim, 5 Drawing Figures

VACUUM SWITCH

BACKGROUND OF THE INVENTION

This invention relates to an improvement of a vacuum switch which is provided with a function of a disconnecting switch.

It is well known that a vacuum switch can interrupt a large current by separating contacts from each other by a small distance and that the surfaces of the contacts are roughened by electric arc generated at the time of interrupting the large current which results in the lowering of the insulating strength. It is found that the shorter the distance between the contacts is, the higher the current interrupting capability becomes, and in view of this fact, there has been proposed two-stage operation wherein the contacts are firstly separated by a distance sufficint for withstanding the recovering voltage after the current interruption and then separated by a large distance to withstand against a predetermined maximum voltage, for example, impulse voltage.

Generally, in an electric power system, a circuit interrupter is used in combination with a disconnecting switch.

From the foregoings it has been proposed an improved vacuum switch incorporating the functions of a current interrupter and a disconnecting switch and having a high interrupting capability and high insulating strength by separating the arc extinguishing chamber of the vacuum switch into two parts, one for current interruption and the other for insulation, thus acting as a disconnecting switch.

Furthermore, in a conventional vacuum switch, an operator cannot observe the inside of the vessel and particularly, the fact that whether the contacts are in opened or closed state for maintenance or inspection of the switch.

SUMMARY OF THE INVENTION

An object of the present invention is to provide a vacuum switch having a function of a disconnecting switch.

Another object of the invention is to provide a vacuum switch having transparent portion on the surface of the vacuum vessel through which the inside of the vacuum vessel can be observed visually.

According to the present invention, there is provided a vacuum switch of the type comprising a vacuum vessel defined by a cylinderical member and end plates sealed to both ends of the cylindrical member, and a pair of separable contacts disposed in the vacuum vessel and the improvement of the vacuum switch comprises a pair of opposing shields surrounding the contacts respectively, the shields being provided with reentrant portions in which the contacts are positioned respectively at opened state and the distance between the opposing faces of the shields is shorter than the distance between the contacts at the opened state. Furthermore, according to this invention a portion of the insulating cylinder corresponding to the gap between the shields is made of a transparent material.

BRIEF DESCRIPTION OF THE DRAWINGS

The other objects and advantages of this invention will be more readily understood from the following description of the preferred embodiments taken in conjunction with accompanying drawings, in which.

DESCRIPTION OF THE PREFERRED EMBODIMENTS

Figure 1:
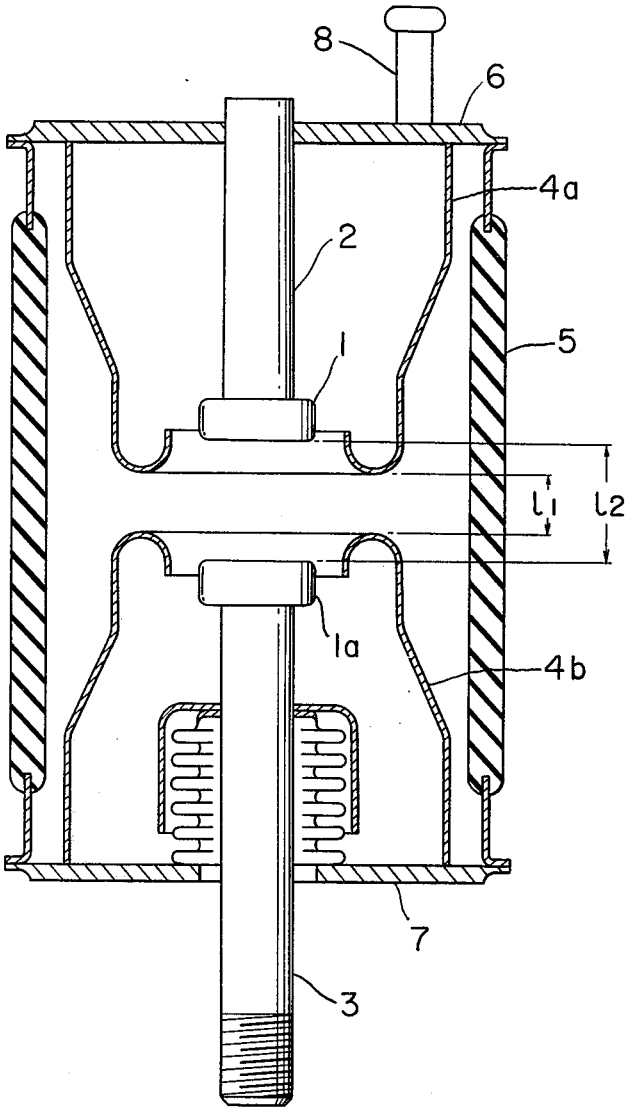
FIG. 1 is a vertical cross sectional view of a vacuum switch according to this invention.

FIG. 1 shows an opened state of the vacuum switch comprising a vacuum vessel defined by an insulating cylinder 5 which is preferrably made of a transparent material such as glass and end plates 6 and 7, and in the vacuum vessel are contained a stationary contact 1 secured to the inner end of a stationary rod 2 and a movable contact 1*a* secured to the inner end of a movable rod 3. There is also provided an evacuation and seal-off tube 8 to one of the end plates 6 and 7 to creat the vacuum condition in the vessel. To the upper end plate 6 supporting the stationary rod 2 is secured a shield 4*a* and to the lower end plate 7 is secured a shield 4*b*. In this opened state of FIG. 1, the distance $l_1$ between the shields 4*a* and 4*b* is made shorter than the distance $l_2$ between the opened contacts 1 and 1*a*.

The contacts 1 and 1*a* are disposed inside of the shields 4*a* and 4*b*, respectively, when they are opened, so that even if a voltage is applied across the contacts, electric field generated near the surfaces of the contacts is alleviated by the shields 4*a* and 4*b* and the insulating strength is remarkably increased. Moreover, since this vacuum switch is constructed as a disconnecting switch, there is no need for interrupting a large current and the high insulating strength can always be kept without damaging the surfaces of the contacts by the arc.

The insulating cylinder 5 of the vacuum vessel is made of a transparent material, so that the interior of the vacuum vessel can be observed visually through the gap between the shields 4*a* and 4*b* and an operator can discriminate easily and clearly the fact that whether the contacts are positioned in the opened or closed state.

Furthermore, if arc strikes across the contacts during the opened state, this abnormal state can also visually be observed and necessary procedure can be taken.

Figure 2:
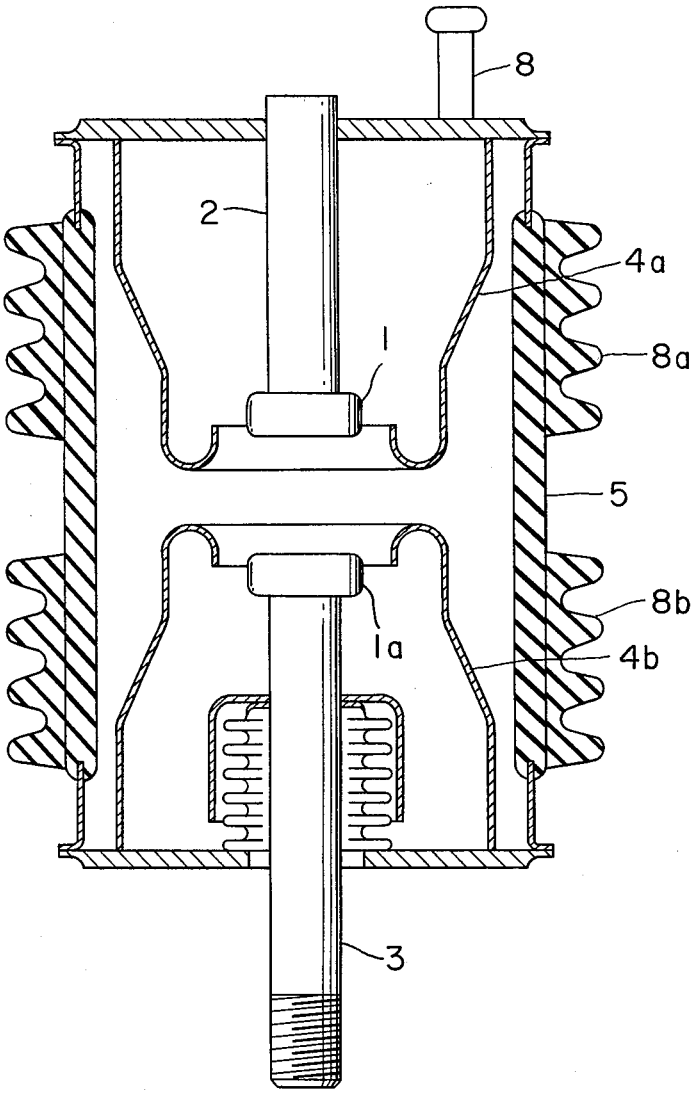
FIGS. 2 and 3 are also vertical cross sectional views showing the other embodiments of the vacuum switch of this invention.

FIG. 2 shows another embodiment of a vacuum switch according to this invention which differs from that of FIG. 1 in the point that corrugations 8*a* and 8*b* made of an opaque insulating material, such as rubber or ceramics, are bonded on the outer surface of the insulating cylinder 5 for increasing the surface leakage distance, but in this embodiment the corrugations 8*a* and 8*b* are not provided on the surface of this insulating cylinder corresponding to the gap between the shields 4*a* and 4*b* so as to enable to visually observe the condition of the contacts.

Figure 3:
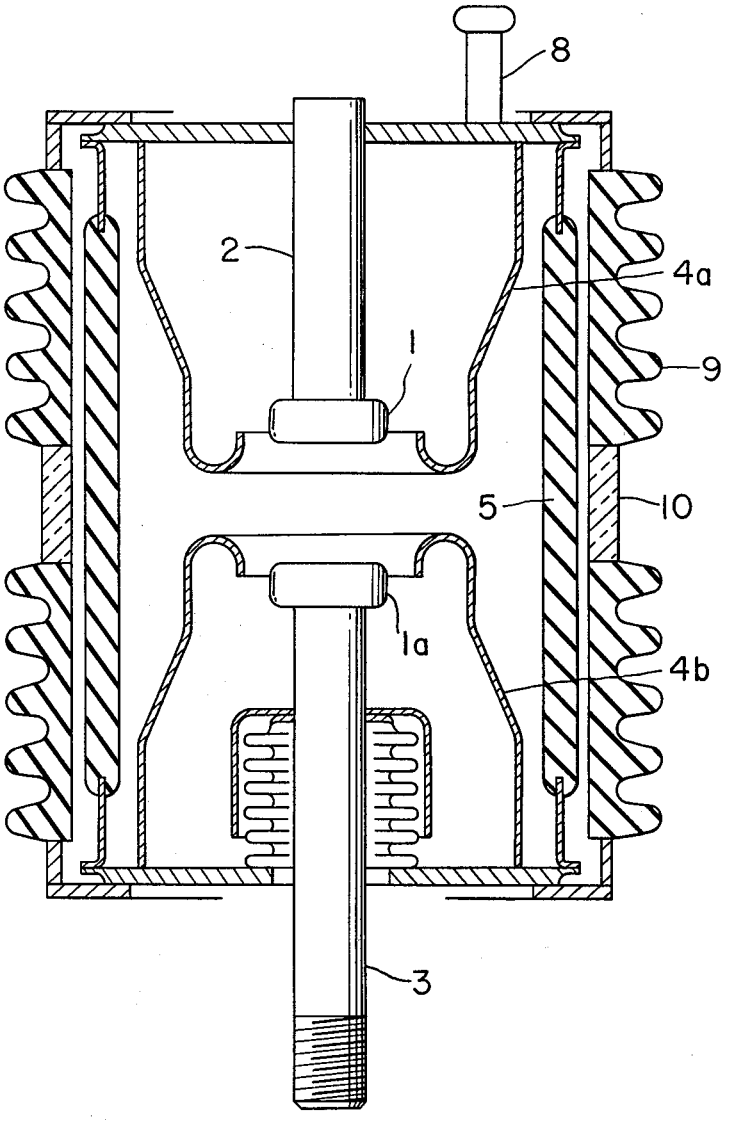

FIG. 3 shows further embodiment of this invention, in which the vacuum switch shown in FIG. 1 is contained in hollow insulator 9 and in this embodiment a portion 10 of the insulator 9 corresponding to the gap between the shields 4*a* and 4*b* is made of a transparent material thereby enabling to observe the inside of the vacuum vessel.

Figure 4:
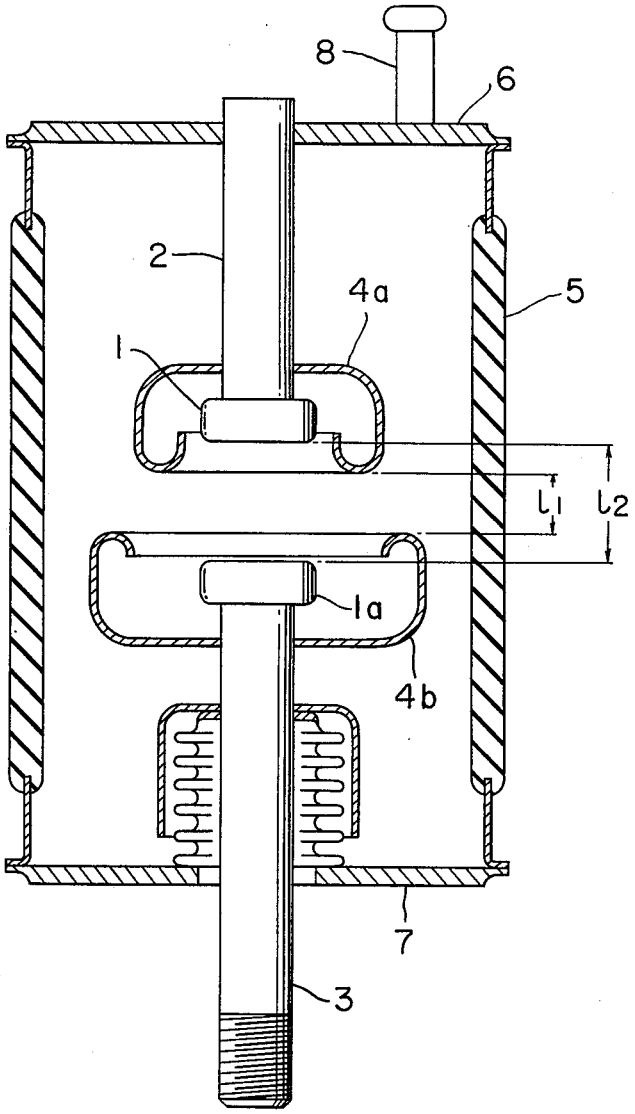
FIG. 4 shows a further modified embodiment of the vacuum switch according to this invention at the opened state of the contacts.
Figure 5:
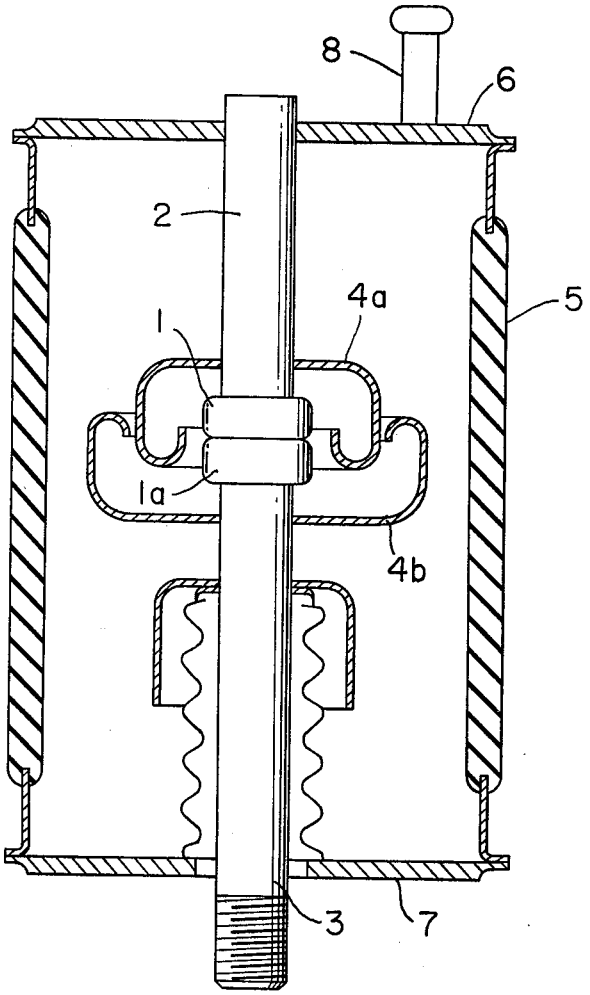
FIG. 5 shows the closed state of the contacts of the vacuum switch shown in FIG. 4.

In the modified embodiment of FIGS. 4 and 5, the shields 4*a* and 4*b* are attached to the rods 2 and 3, respectively, in which the distance $l_2$ between both contacts 1 and 1*a* is also larger than the distance $l_1$ between the shields 4*a* and 4*b* at the opened state as shown in FIG. 4, and the diameters of both shields 4*a* and 4*b* are designed so that the shield 4*a* will be positioned inside the shield 4*b* at the closed state as shown in FIG. 5.

Furthermore, although not shown, it is also possible to attach one end of the shield 4*a* shown in FIG. 4 or 5 to the end plate 6 as shown in FIG. 2.

In the aforementioned embodiments of this invention, the insulating cylinder 5 was made of transparent glass or ceramic material, but the cylindrical member of this invention is never limited to such material and the member may be constructed by a metal cylinder which is provided with a glass window at a portion corresponding to the gap between the shields to permit direct observation of the interior of the vacuum vessel. With such construction it is of course necessary to connect the both ends of the metal cylinder to the end plates through an insulating material.

It will be apparent from the foregoing description according to the present invention there is provided a vacuum switch capable of acting as a disconnecting switch with high insulating strength.

I claim:

1. In a vacuum switch of the type comprising a vacuum vessel defined by a cylindrical member and end plates sealed to both ends of said cylindrical member, a pair of separable contacts each secured to a rod and disposed in said vacuum vessel, and a pair of opposing shields surrounding said contacts, respectively, said shields having reentrant portions in which said contacts are positioned respectively at an opened state, and the distance between opposing faces of said shields being shorter than the distance between said contacts at the opened state, the improvement in which each of said shields has one end surrounding one of said contacts and the other end secured to a corresponding one of said rods in a manner that the diameters of said shields are designed so that the shield of the stationary side will be positioned inside the other shield at the closed state, and at least a portion of said cylindrical member corresponding to a gap between said shields is made of a transparent material thereby enabling the visual observation of the movement of said contacts inside the vacuum vessel.

* * * * *